US005199515A

United States Patent [19]

Sinclair et al.

[11] Patent Number: 5,199,515

[45] Date of Patent: Apr. 6, 1993

[54] DRY PNEUMATIC SYSTEM FOR HARD ROCK SHAFT DRILLING

[75] Inventors: Kirk M. Sinclair, Lively; John R. England, Sudbury, both of Canada

[73] Assignee: Inco Limited, Toronto, Canada

[21] Appl. No.: 633,454

[22] Filed: Dec. 24, 1990

[30] Foreign Application Priority Data

Jan. 3, 1990 [CA] Canada ..... 2007070

[51] Int. Cl.[5] ..... E21B 21/02; E21B 21/12

[52] U.S. Cl. ..... 175/213; 175/215; 175/324; 175/325.3

[58] Field of Search ..... 175/324, 213, 215, 53, 175/71, 325; 285/134, 136, 151, 152

[56] References Cited

U.S. PATENT DOCUMENTS

| | | | |
|---|---|---|---|
| 682,939 | 9/1901 | Ivens | 175/213 |
| 1,428,788 | 9/1922 | Larsen | 175/213 |
| 3,297,100 | 1/1967 | Crews | 175/215 |
| 3,360,061 | 12/1967 | Canalizo | 175/324 |
| 4,186,808 | 2/1980 | Cox | 175/213 X |
| 4,293,039 | 10/1981 | Mullins et al. | 166/34 |
| 4,301,876 | 11/1981 | Harrison et al. | 175/53 |
| 4,304,309 | 12/1981 | Fercho et al. | 175/95 |
| 4,365,677 | 12/1982 | Owens | 175/73 |
| 4,384,747 | 5/1983 | Hodge | 175/325 |
| 4,516,633 | 5/1985 | Richardson et al. | 175/213 X |
| 4,534,426 | 8/1985 | Hooper | 175/324 X |
| 4,627,501 | 12/1986 | Ebeling | 175/325 X |

FOREIGN PATENT DOCUMENTS

| | | | |
|---|---|---|---|
| 1056366 | 6/1979 | Canada . | |
| 3302117 | 7/1984 | Fed. Rep. of Germany | 175/324 |
| 276511 | 2/1990 | Fed. Rep. of Germany | 175/71 |

OTHER PUBLICATIONS

J. Powell and K. Ruby, "Pneumatic Conveyor Equipment Applied to Mine Shaft Sinking", Trans. Instn Min. Metall. (Section A:Min. Industry), 90, Apr. 1981 (excerpt pp. A69 and A70).

*Primary Examiner*—Hoang C. Dang
*Attorney, Agent, or Firm*—Edward A. Steen

[57] ABSTRACT

A dry, vertical shaft drilling system including an inverted raiseboring cutterhead fitted with air nozzles and vacuum pickups. Weights are detachably stacked above the cutterhead. Cuttings are extracted through the weights into a swivel circumscribing the drill string. The swivel is a transition from the rotating cutterhead to the stationary extraction riser pipes disposed above the swivel. Non-rotating stabilizers stabilize the drill string.

16 Claims, 8 Drawing Sheets

DRY PNEUMATIC SYSTEM FOR HARD ROCK SHAFT DRILLING

TECHNICAL FIELD

The instant invention relates to underground shaft drilling in general and, more particularly, to a dry pneumatic system capable of drilling wide diameter shafts into hard rock formations from within established underground excavations.

BACKGROUND ART

In underground mines, a main vertical shaft generally provides vertical access to all working levels. Oftentimes, exploratory drilling indicates that additional ore lies beneath the deepest level which is below the access provided by the shaft.

In these instances, it is necessary to provide access to these additional reserves by either deepening the existing shaft or developing a decline system.

As can be readily appreciated, deepening an existing shaft is a difficult undertaking at best. Besides being disruptive to the normal operation of the mine, deepening the shaft is time consuming, expensive and fraught with safety considerations.

Large diameter shafts are being drilled in the United States and elsewhere. While not widely practiced, several techniques are used.

Most of these shafts are drilled from the surface using modified oil rigs. Double or triple wall drill string is often used to permit two-way travel of bailing fluid to and from the cutting face. Multi-phase systems employing injected air to assist circulation have been used with varying degrees of success. Reverse circulation systems are the most widely used, with bentonite mud or water as the preferred media.

Fluid jets are used to agitate the cuttings as they are created and to clean the rock area ahead of the cutter prior to contact. The suspended cuttings swirl with the rotation of the cutterhead, spiralling towards a central pickup point for hydraulic transport through the string to surface. The cuttings are removed through a series of cyclones, screens and desilters prior to recirculation of the hydraulic fluid.

The vast majority of these shafts are drilled in the softer sediments associated with coal deposits, with stratified lithologies and water-bearing horizons. It is advantageous in some cases to maintain a high fluid level in the hole during drilling, which provides hydrostatic support to the shaft walls. After drilling is complete, shaft liners can be floated into place and pinned or grouted.

The Sudbury, Ontario, Canada rock formations are much harder and different equipment is necessary to provide satisfactory drilling performance. Carbide cutters must be used to provide reasonable penetration rates and cutter life. A much greater proportion of fines are produced during drilling which affect the design and selection of a bailing system.

The size and power requirements of the drill rig, and the costs associated with the multiple wall drill string and fluid cleaning equipment generally preclude it from consideration as a feasible means of drilling shafts in an underground hard rock environment.

SUMMARY OF THE INVENTION

The system comprises an inverted raiseboring cutterhead fitted with air nozzles and vacuum pickups. Weights are stacked above the cutterhead to provide downward cutting force. Cuttings are extracted through the weights into a swivel. Non-rotating riser pipes, affixed to the swivel, bring the cuttings to the collar of the shaft. Non-rotating stabilizers stabilize the drill string within the shaft.

PREFERRED EMBODIMENT OF THE INVENTION

Figure 1:
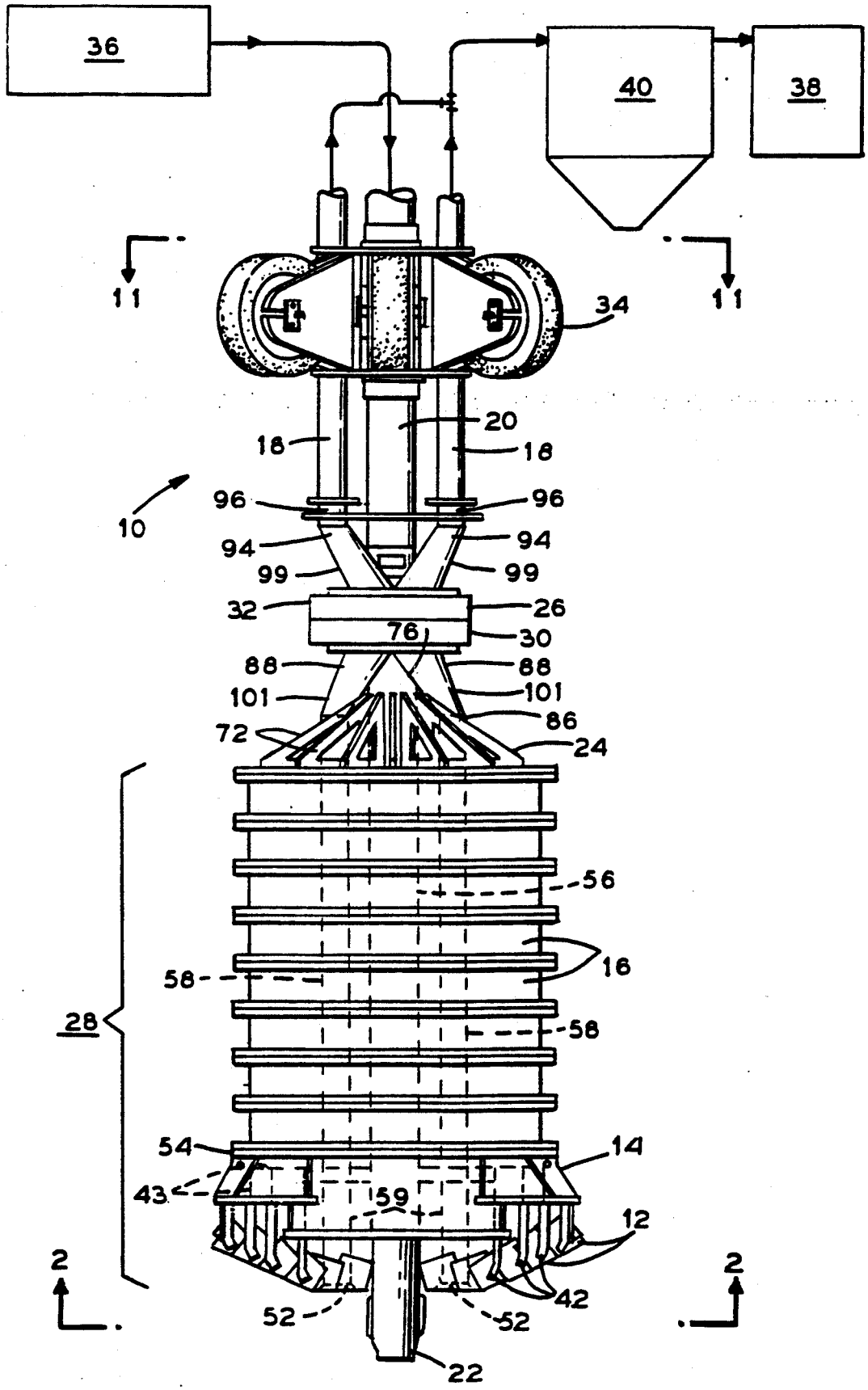
FIG. 1 is an elevation of an embodiment of the invention.

FIG. 1 depicts the raiseboring system 10. The system 10 includes an inverted cutterhead 12 and an adjacent plenum 14. A plurality of stackable weights 16 are affixed to the plenum 14. Passing through the weights 16 and the plenum 14 are a pair of outer bores 58. A central bore 56 passes through the weights 16. A stem 22 adapted to receive a drill bit (not shown) extends from the cutterhead 12.

A flange 24 is detachably affixed to the uppermost weight 16. The outer bores 58 pass through the flange 24 and a drill string 20, via pipe 76, is affixed to the flange 24.

A pneumatic swivel 26 circumscribes the drill string 20 and is flowably connected between riser pipes 18 and the outer bores 58. The pneumatic swivel 26 permits the cutter head 12, the plenum 14, the weights 16 and the flange 24—collectively the bottom hole assembly ("BHA") 28—along with the central and outer bores 56 and 58 disposed within the weights 16 to freely rotate. The riser pipes 18 above the swivel 26 remain stationary. The rationale for this construction will become readily apparent.

The riser pipes 18 continue upwardly through non-rotating stabilizer 34. The stabilizer 34 is connected to the riser pipes 18 and freely envelops the drill string 20.

The drill string 20 ultimately is connected to the drive head of a raiseboring machine (not shown) disposed a predetermined distance above the BHA 28. A first compressor 36 injects compressed air into the interior of the drill string 20 and down toward the bottom of the cutterhead 12. A second compressor 38 draws a vacuum in the riser pipes 18 through a dust collecter 40.

The invention and the means of applying it may be better understood by a brief discussion of the principles underlying the invention.

The ultimate objective of the instant invention is to drive relatively wide vertical shafts into hard rock formations. By inverting a raiseboring cutterhead 12 and utilizing a dry bailing concept, air is injected downwardly through the drill string 20 and into the cutterhead 12. The air is distributed to an array of nozzles 42 extending from the plenum 14.

The air exiting the nozzles 42 at high velocity agitates the cuttings and forces them towards intakes 52. Since the intakes 52 are subject to a vacuum via the associated riser pipes 18 and the outer bores 58, the cuttings flow upwardly towards the dust collector 40.

By using a dry system rather than a wet (hydraulic) system, a significant number of improvements are realized:

1) Pneumatic nozzles are not submerged, allowing the use of an unconfined jet which is more effective at controlling movement of the rock particles.

2) The non-submerged environment does not require cutters with special pressure compensating seals.

3) The non-submerged environment removes the buoyancy effect and thus fewer weights are required to apply the necessary cutting force.

4) A sump and equipment required to muck the sump are not required.

5) Bailing water would be expected to contain a high fines fraction which requires a longer residence time for clarification. This greatly increases both sump size and total system water requirements.

6) Auxiliary fluid cleaning equipment such as screens, desanders, desilters and hydrocyclones are not required.

7) The completed shaft does not require dewatering.

8) The trash pumps would wear at an accelerated rate and would contribute to considerable added expense and delays to maintain and replace.

The instant push/pull concept 10 comprises separate air injection and vacuum extraction systems. This design, believed to be more efficient, eliminates the awkward and failure-prone shaft seal and the complex associated equipment.

The system 10 employs, in part, the extremely heavy static weight load of the weights 16 to grind the rock at the cutterhead/ground interface. Accordingly, although not shown, the powerful raiseboring machine drive head must have the capability to lift and rotate the entire BHA 28 as well as the drill string 20. At the present time, a Robbins TM 85RH hydraulic raiseboring machine is suitable. Rated at 400 horsepower (298 kw), it delivers 370,000 ft-lbs ($1.65\times10^6$N) of torque.

In order to collar the shaft, it is necessary to place the machine at an appropriate elevation so there is ample room below the unit to assemble the BHA 28 with the attendant weight stack to begin drilling. The entire system 10 can easily weigh 1,000,000 pounds ($4.5\times10^5$ kg).

Inasmuch as the BHA 28 rotates whereas the riser pipes 18 above the swivel 26 do not, consideration must be paid toward supporting the upper riser pipes 18. Support by suspension of the riser pipes 18 places the columns in tension which taxes the strength and rigidity of the various pipe connections. Accordingly, the non-rotating stabilizer 34 was developed. Stabilizers 34 placed at regular intervals on the drill string provide vertical support and maintain columnar alignment of the riser pipes 18 while the remaining weight is carried by the pneumatic swivel 26. This provides support without hanging the riser pipes 18 and ensures that they move up and down in the shaft with the BHA 28.

Attention is now directed toward the various components of the system 10.

Figure 2:
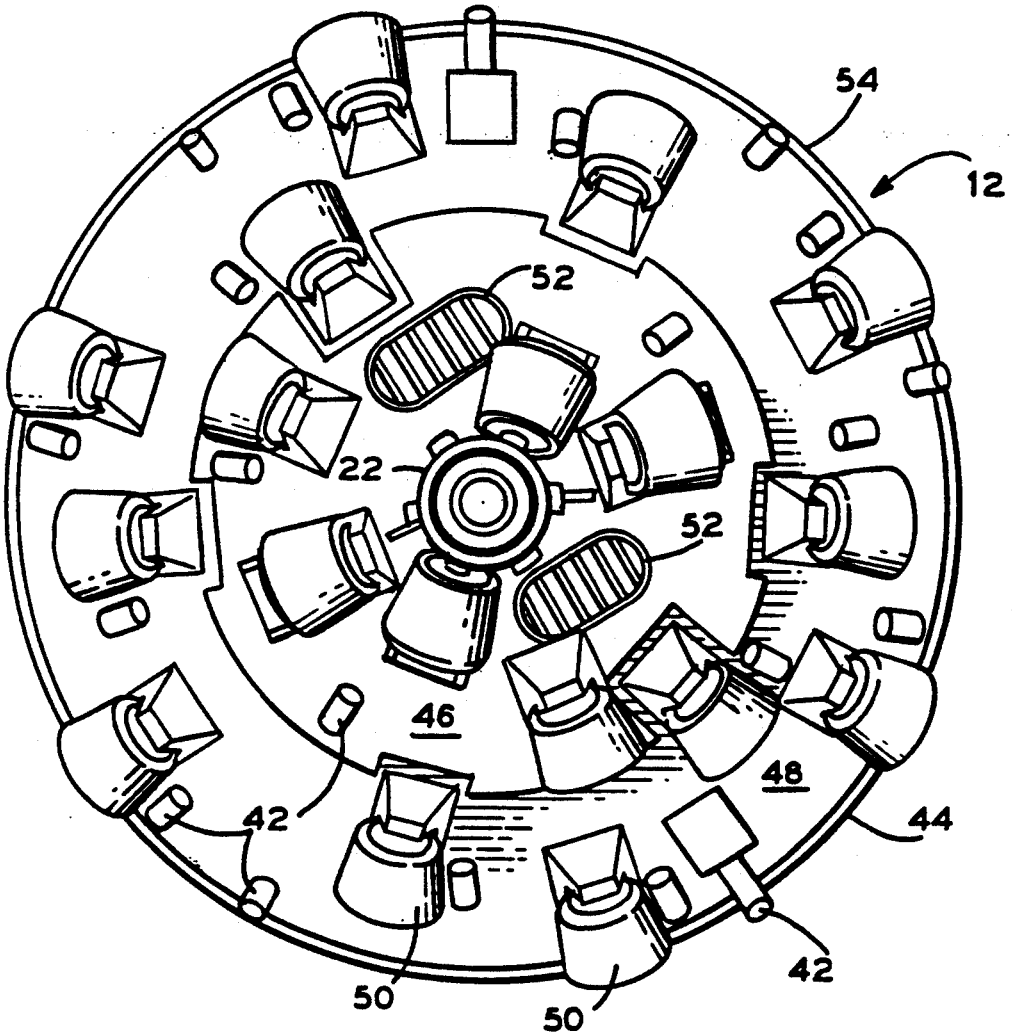
FIG. 2 is a view taken along line 2—2 of FIG. 1.

FIG. 2 shows the cutting face 44 of the cutterhead 12. The embodiment shown in FIGS. 1 and 2 is a modified Baker-Hughes TM raiseboring cutterhead 12. The face 44 includes a flat central area 46 with sloped sides 48. The face 44 includes a plurality of hard rock sealed carbide cutters 50 of the random carbide placement type.

A plurality of canted air nozzles 42 extend away from the plenum 14. Air directed down the drill string 20 enters the plenum 14 and is distributed to the nozzles 42 by tubes 43. (See FIG. 1) Two grated intakes 52, adjacent to the stem 22, communicate with the outer bores 58 via plenum conduits 59. (See FIG. 1)

The desired push/pull pneumatic bailing concept is achieved by air exiting the nozzles 42 at high velocity, sweeping across the cutting face 44, and leaving the face 44 through the vacuum extraction intakes 52.

The system 10 depends on high air velocities which provide energy to move the rock particles to an area of low pressure. At this point, cuttings under the influence of the vacuum compressor 38 are pulled upwards and away from the cutting face 44.

This is achieved by a nozzle 42 placement that ensures that every part of the face 44 is cleaned at least once per cutterhead 12 revolution. Nozzles 42 placed in the path of each cutter 50 accomplish this while permitting maximum penetration per pass, since the cutters 50 only contact freshly cleaned solid rock.

Standard raiseboring cutters have rows of carbides which create circular grooves in the cutting face called kerfs. In hard rock, the ridges between these kerfs can extend high enough to erode the matrix between the cutter carbides. Periodically, the cutters will climb over these ridges, breaking them off. This causes the head to lift from the face and then drop down again.

In order to prevent this bouncing effect which may damage the BHA 28 or the drill string 20, the random carbide placement cutters 50 leave no kerf ridges. The shaft's face is smoother and bouncing is minimized. This reduces matrix wear, extending cutter 50 life.

The top rim 54 of the cutterhead 12 include bolt holes (not shown) for affixing the cutterhead 12 directly to the weights 16.

Figure 4:
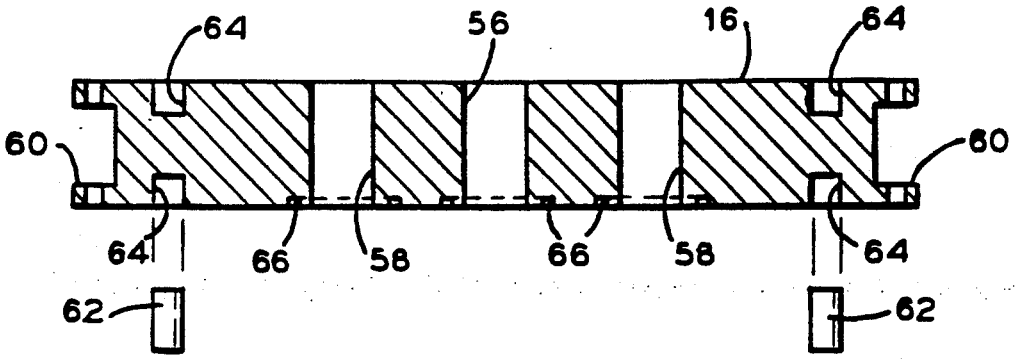
FIG. 4 is a view taken along line 4—4 of FIG. 3.
Figure 3:
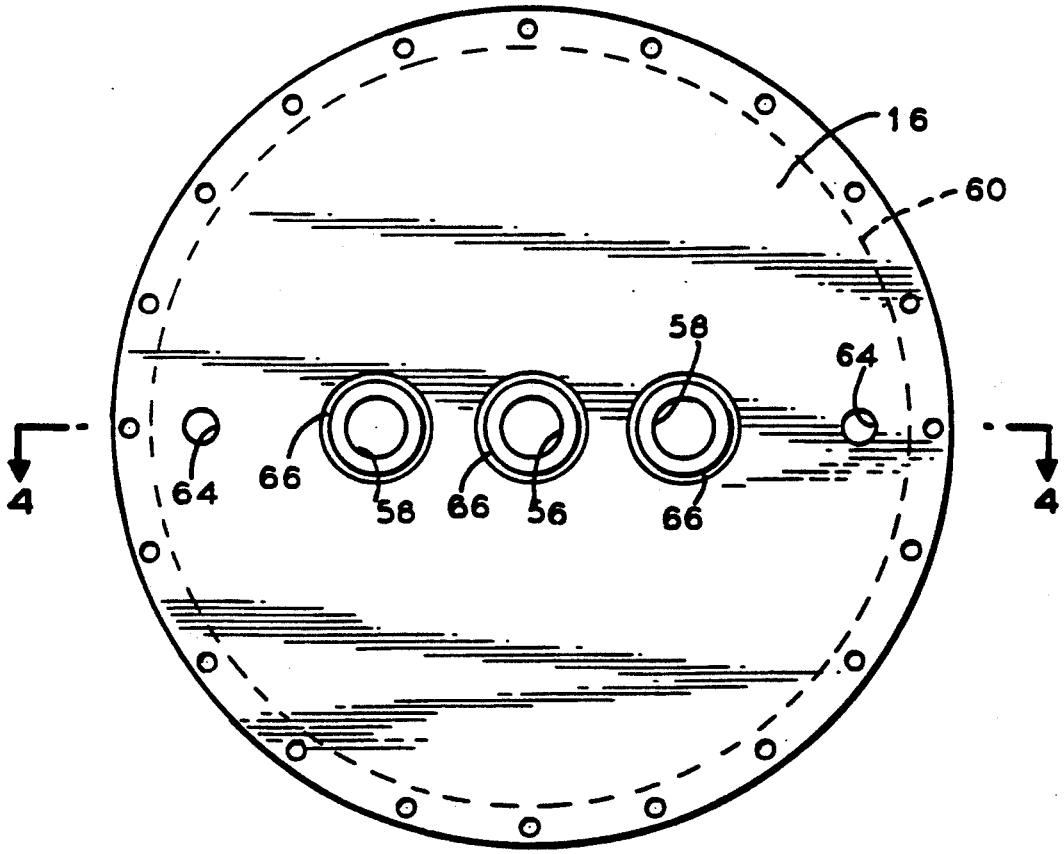
FIG. 3 is a plan view of a feature of the invention.

Turning now to FIGS. 3 and 4, there is shown a weight 16 in plan and cross-section respectively. The weights 16 are designed to stack upon each other, carry the weight load and transmit the torque capacity of the raiseboring machine.

Each weight 16 is made from steel plate having a central bore 56 and two outer bores 58. A bolt flange 60 allows adjacent weights to be affixed to one another. Dowels 62 fit into cups 64 to permit torque transmission while saving wear on the bolts (not shown) inserted through the flanges 60. One side of the weight 16 includes O-ring slots 66 for sealing purposes.

Figure 5:
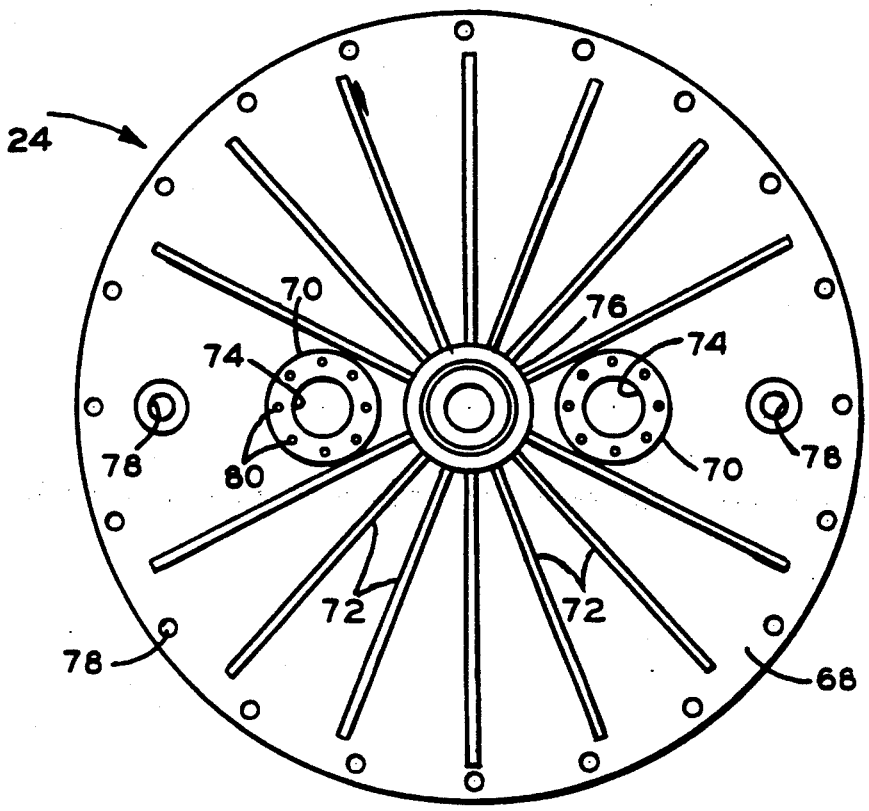
FIG. 5 is a plan view of a feature of the invention.
Figure 6:
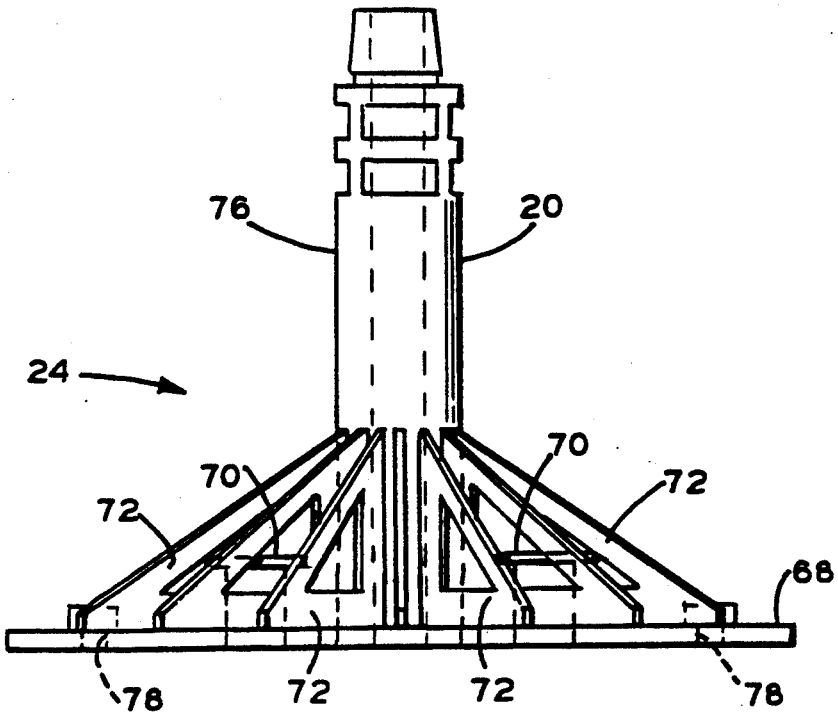
FIG. 6 is an elevation of the feature shown in FIG. 5.

As shown in FIGS. 5 and 6 the attachment flange 24 provides a connection between the drill string 20 and the weights 16. The swivel 26 circumscribes the drill string 20 above the flange 24.

The flange 24 supports the stack of weights 16 during cutter 12 changes and after completion of the hole. During drilling, the flange 24 transmits the torque of the raiseboring machine. It further has been identified as the principle point of flexure in the BHA 28.

The flange 24 consists of a standard drill string pipe 76 press fitted and welded through the center of plate 68 and joined together by a plurality of welded gussets 72. Dowel cups 78 mate the flange 24 to the top weight 16. Bolt holes 80 and gasket flange 70 accommodate pipe 86 connections from the swivel 26.

The drill pipe 76 is long enough to extend beyond the swivel 26 to accommodate a breakout tool.

Figure 7:
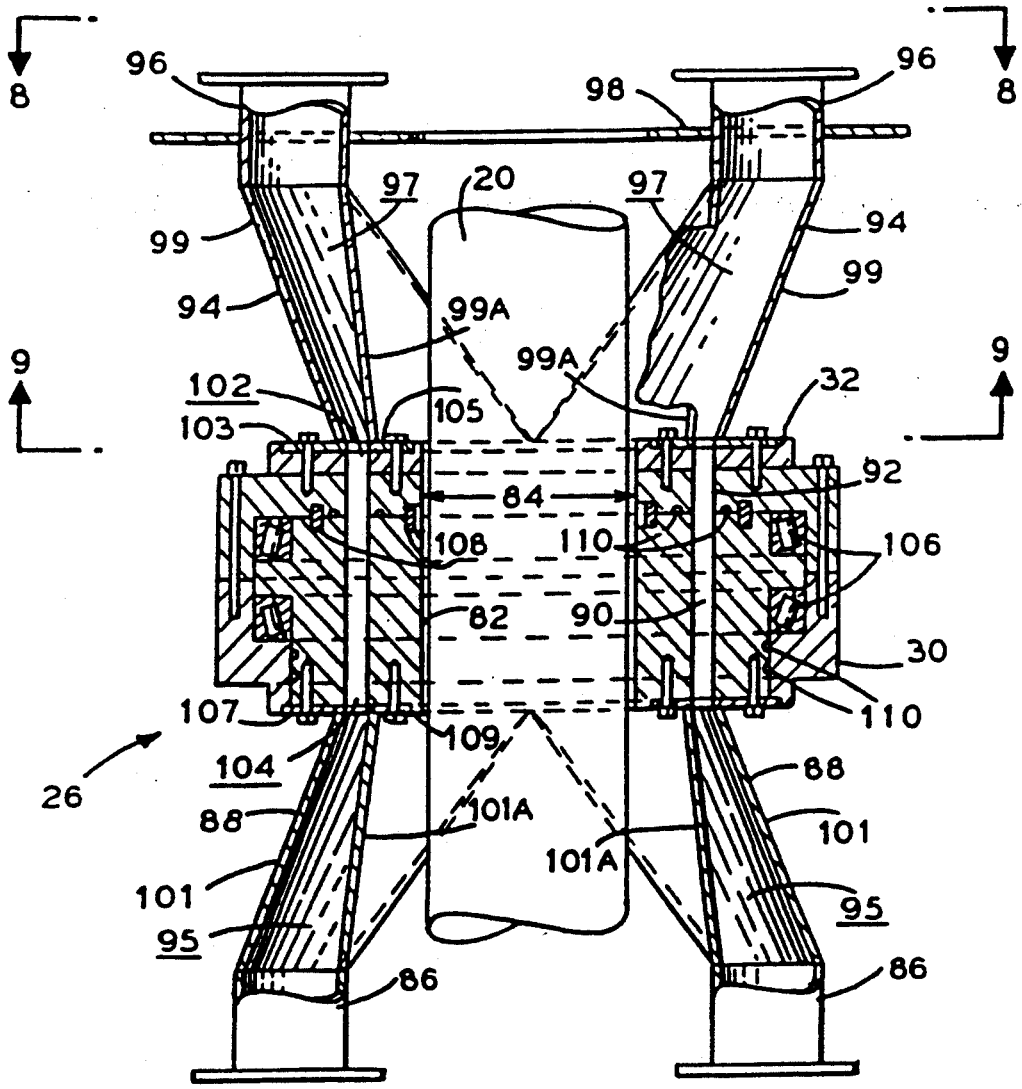
FIG. 7 is a partial cross-sectional view of a feature of the invention.

The pneumatic swivel 26, as shown in FIG. 7, by virtue of its one half fixed/one half rotatable design permits the upwardly rising cuttings to travel through two rotating ports and two fixed ports.

The swivel 26 consists of upper housing 32 affixed to lower housing 30. Rotatably disposed within the housings 30 and 32 is rotating member 82. The coupled housings 30 and 32 remain stationary whereas the rotating member 82 is free to rotate. The inner diameter 84 of the swivel 26 allows for free clearance between the walls of the rotating drill string 20 and the interior of the swivel 26. That is, the drill string 20 passes through the swivel 26 unencumbered.

Lower pipes 86 are securely bolted to the flanges 70 and flowingly communicate with the corresponding cylinders 74 of the flange 24. Upper pipes 96 are securely affixed to the riser pipes 18. Lower transition zones 88 are affixed to the rotating member 82 and are coincident with its first annular passage 90. The first annular passage 90 flowably communicates with second annular passage 92 of the upper housing 32. The second annular passage 92 opens into upper transition zones 94. The upper transition zones 94 are connected to upper pipes 96. Plate 98 provides structural support to the upper transition zones 94.

The upper transition zones 94 are mounted to the upper housing 32 via outer ring 103 and inner ring 105. These two rings 103 and 105 define third annular passage 102. Similarly, the lower transition zones 88 are mounted to the lower housing 30 via outer ring 107 and inner ring 109. These two rings 107 and 109 define fourth annular passage 104.

Figure 8:
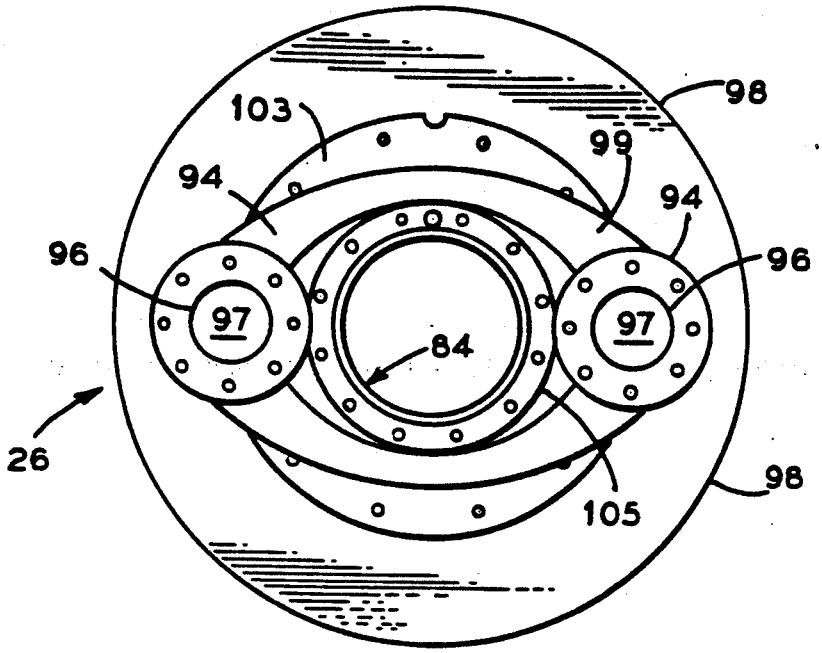
FIG. 8 is a view taken along line 8—8 of FIG. 7.
Figure 9:
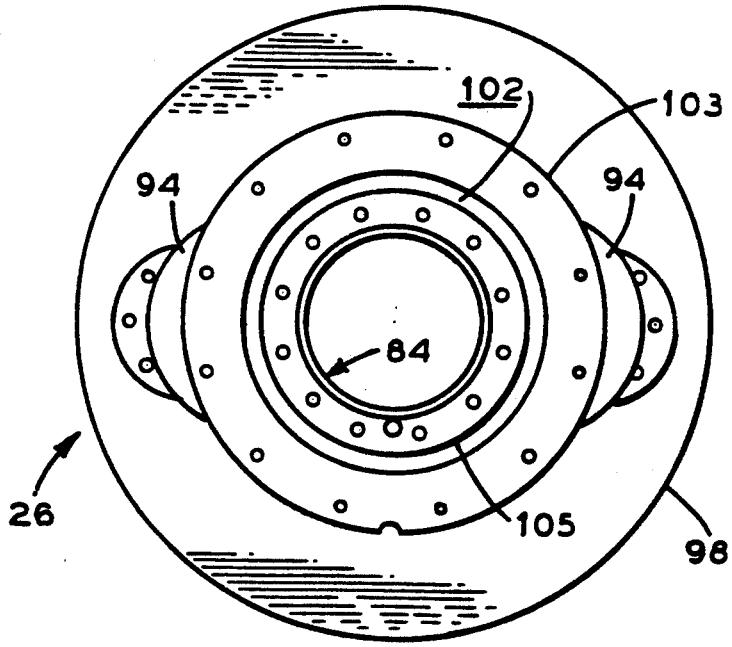
FIG. 9 is a view taken along line 9—9 of FIG. 7.
Figure 10:
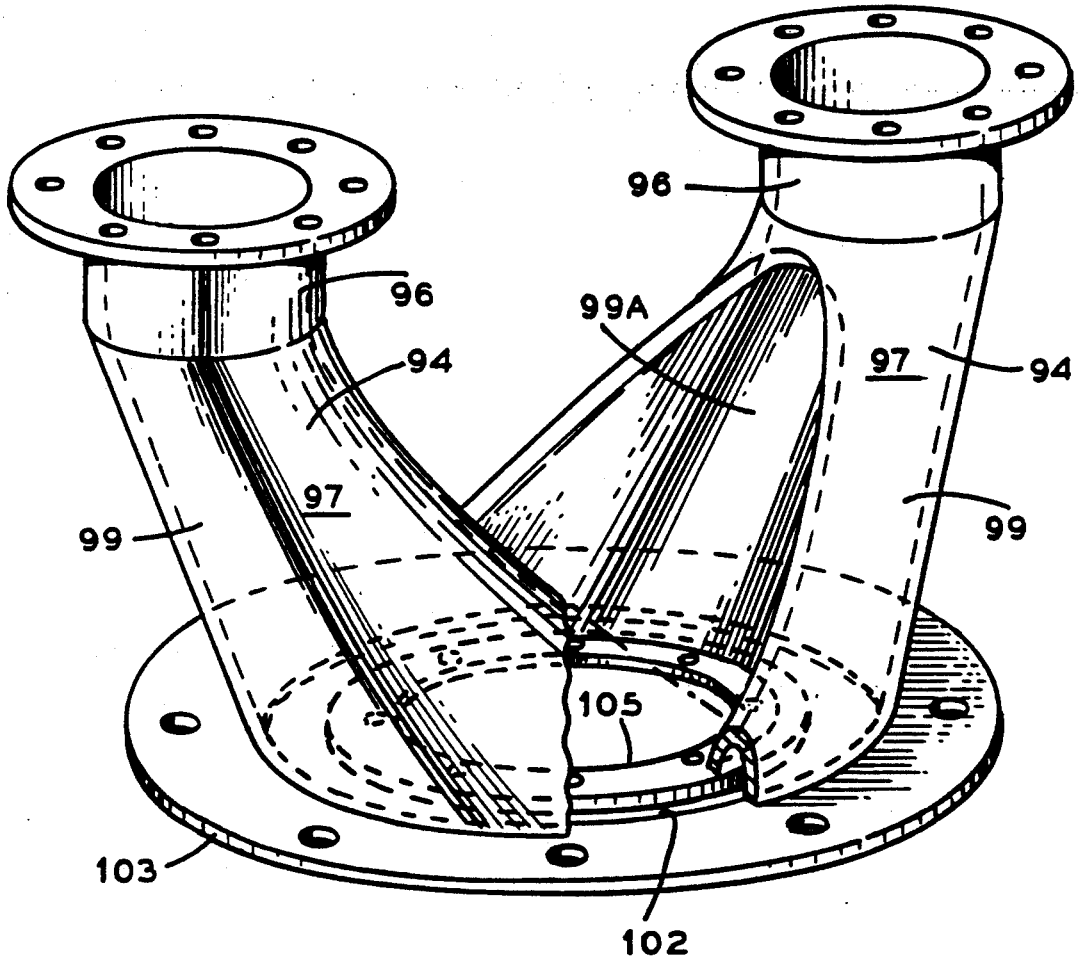
FIG. 10 is a perspective view of a feature of the invention.

FIGS. 8, 9 and 10 depict the upper transition zones 94 although in fact the lower transitions zone 88 are identical except that the plate 98 is fixed to the upper transition zones 94 only. FIGS. 9 and 10 in particular, show the third annular passage 102 is mated directly to the second annular passage 92 of the upper housing 32. The third annular passage 102 funnels the cuttings to either of the two upper pipes 96. (The similar fourth annular passage 104 is shown in FIG. 7).

The shape of the transition zones 88 and 94 is a conical frustum. See *Marks' Standard Handbook for Mechanical Engineers*, 9th ed., page 2–10, Figure 2.1.50, ed. by Avallone and Raumeister III, McGraw-Hill, N.Y., 1987. The passages 102 and 104 initially start out as annular rings. As one proceeds away from the passages 102 and 104 as shown in FIG. 7, (and FIG. 10) the sides 99 and 101 of each zone 94 and 88 separate forming two sweeping discrete leg-like frustoconical curved funnel flow chambers 95 and 97 that gradually widen. The sides 99 and 101 of the zones 94 and 88 form a modified swept "V" shape with each flow chamber 95 and 97 flaring out to the pipes 86 and 96. The interior sides 99A and 101A are scooped out. In a sense, the two chambers 95 and 97 may be visualized as two partially tapered pants legs pulled apart and drying on a clothes line. The belt area is analogous to the annular passages 102 and 104 and the end of each pants leg is affixed to the pipes 86 and 96. The interiors of the pants legs are tapered at the belt area and then flare out with the inseam pushed outwardly.

In view of the differing physical configurations of the riser pipes 18, the transitional zones 88 and 94 and the annular passages 90, 92, 102, and 104 attention must be paid to the flow characteristics of the cuttings flow. Drastic changes in velocity would cause the settling out of some of the entrained material. Accordingly, the area of cross-section of any horizontal slice through the swivel 26 should be ideally constant, so as to maintain flow velocity and reduce settling. The theoretical ideal requires that the cross-sectional area of the flow path measured orthogonally to the air flow vector at any point should be constant. The constant is numerically equal to the area of cross-section of the two inlet pipes 86 entering the swivel 26.

Due to the tremendous forces exerted on the swivel 26, the bearings, races and seals must be robust. In addition, the dry erosive nature of the cuttings flowing upwardly through the annular passages 90 and 92 wreak havoc with these components.

The swivel 26 includes two sets of straight bore, single roller bearings 106 that are adapted to maintain alignment of the various swivel 26 components during rotation and provide the requisite static loading characteristics.

In order to protect the interface between the upper housing 32 and the rotating member 82 from the deleterious effects of the erosive dry cuttings, Caterpillar Inc.'s Duo-Cone TM metal/toric seals 108 are disposed about the annular passages 90 and 92. In addition, a series of quad ("x" cross-section) O-ring rubber seals 110 further protect the main seal 108. A small drip tank (not shown) mounted on top of the swivel 26 provides a small oil reservoir to lubricate the bearings 106 and the main seal rings 108.

Figure 11:
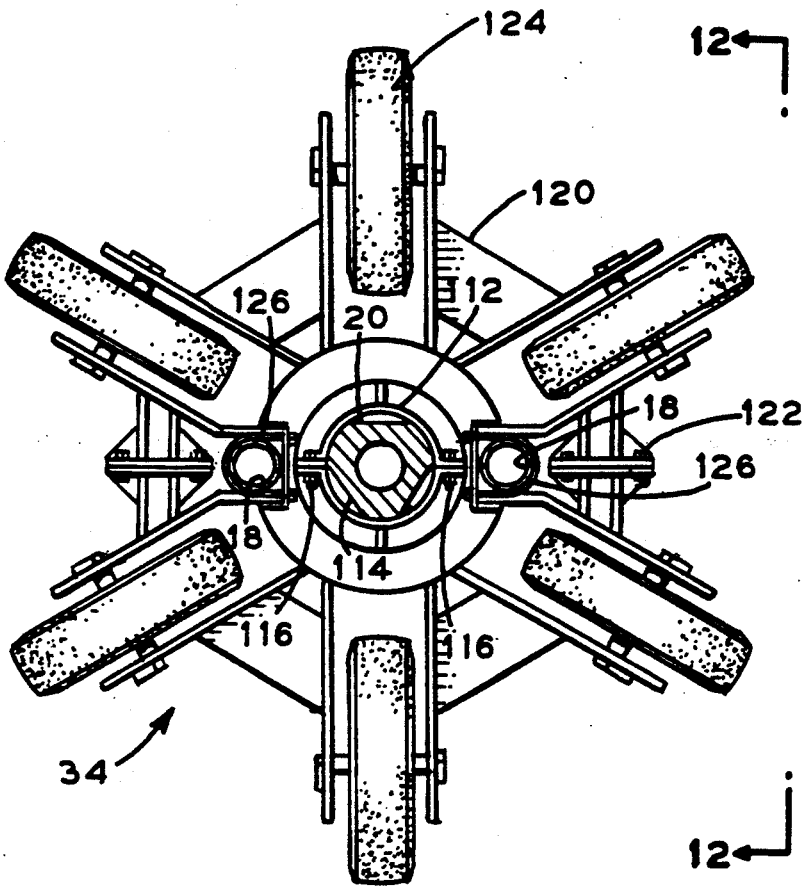
FIG. 11 is a view taken along line 11—11 of FIG. 1.
Figure 12:
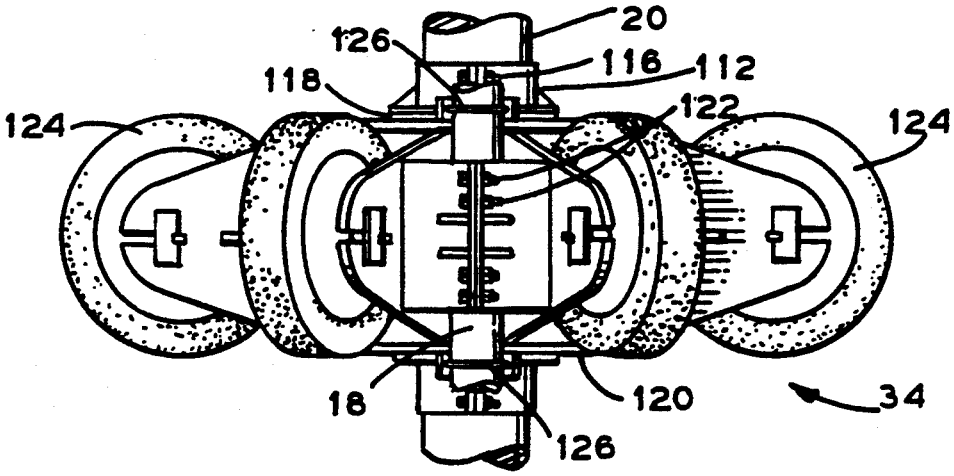
FIG. 12 is a view taken along line 12—12 of FIG. 11.

FIGS. 11 and 12 are the plan views and elevations of the non-rotating stabilizer 34. Each stabilizer 34 provides support and vertical alignment for the riser pipes 18. Moreover, the stabilizer 34 tends to confine the drill string during occasional rod whip that could potentially damage the riser pipes 18.

The stabilizers 34 are designed to be assembled around the drill string 20 since the drill string 20 cannot be uncoupled during the shaft drilling phase. They may be moved up and down along the walls of the drilled shaft but they do not rotate. The stabilizers 34 provide a fixture for clamping the riser pipes 18 for support and alignment.

As can be seen from FIGS. 11 and 12 the stabilizer 34 consists of a number of segments, each segment being divided into symmetrical halves which allow for assembly around the drill string 20.

A rotatable carrier bracket 112 is adapted to be attached to wrenching slots 114 of the drill string 20. Fasteners 116 clamp the bracket 112 about the drill string 20 and allow the entire stabilizer 34, when loosened, to slide up and down. A two piece tubular, flanged polyurethane bushing 118 is disposed around the bracket 112. It permits the bracket 112 to rotate with the drill string 20 while the stabilizer 34 remains fixed in place.

A two piece spoke frame 120 is held together by fasteners 122. A series of pneumatic, rubber, airplane type tires 124 are attached to the frame 120. The frame 120 is clamped to the riser pipes 18 by U-bolts 126.

The tires 124 tend to damp out vibrations. By slightly compressing against the walls of the shaft, they act as pneumatic snubbers absorbing some of the vibrating energy generated by the drilling system 10 as well as holding the various components stationary.

It has been determined that to ensure proper bailing, the system 10 should preferably move the cuttings at a speed between 5200–5600 feet per minute (1585–1707 meters/minute). Slower speeds may clog up the system whereas faster speeds may cause premature erosion. Accordingly, it is preferred to maintain the system's volume throughput above 2100 cubic feet per minute (59 $m^3$/minute).

Suction pressure must be adequate to overcome line loss resistance. Estimated total looses attributable to the drill string 20, riser pipes 18, swivel 26, cutterhead 12, and dust collector 40 are 90 inches water gauge ($3.04\times10^5$ Pa). The compressors 36 and 38 must be sized with these numbers in mind.

The sequence of events for assembling and operating the system 10 is briefly set forth.

The raiseboring machine is erected at an elevated horizon. A pilot hole is drilled downwardly from the stope from where the shaft is to be sunk. The pilot hole collar is slightly below the raiseboring machine and above the shaft collar. Upon completing the pilot hole, the bit and string are removed and replaced with the cutterhead 12. A short raise should be bored over the collar location to create the headroom for the shaft drilling equipment.

The BHA 28 is assembled as follows. The first stabilizer 34 is installed on the drill string 20; then the swivel 26 and the flange 24 are attached together; and finally the weights 16 are affixed. The cutterhead is attached to the lowest weight 16 and drilling commences.

Drilling continues until there is room to install more weights 16. When a sufficient number of weights 16 have been added to give optimum penetration, drilling continues. Additional stabilizers 34 may be installed at approximately 50 feet (15 m) intervals.

Additional drill string pipe, which in standard form are 5 feet (1.5 m) long, are periodically inserted at the raisebore machine level. Similarly, the riser pipes 18 which are generally 10 feet (3 m) long, are affixed at the shaft collar. The raiseboring machine is capable of regulating the pressure of the cutterhead 12 and also raising and lowering the system 10 as necessary. Similarly, when the drill string pipe 20 and the riser pipes 18 must be added or removed, the raiseboring machine will lift or lower the drill string and riser pipes as necessary.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

The embodiments of the invention in which an exclusive property or privilege is claimed are defined as follows:

1. A dry, vertical, shaft drilling system, the system comprising of a rotatable bottom hole assembly, the bottom hole assembly including a cutterhead and a variable number of weights disposed above the cutterhead, a rotatable drill string connected to the bottom hole assembly, air supply means extending downwardly to the cutterhead, the air supply means divided into an upper segment and a lower segment, a portion of the lower segment of the air supply means disposed within the cutterhead for agitating cuttings at the cutterhead, air extraction means extending upwardly away from the cutterhead, the air extraction means divided into an upper segment and a lower segment, a portion of the lower segment of the air extractions means disposed within the cutterhead for extracting the cuttings at the cutterhead, means for stabilizing the system within the shaft, swivel means disposed above the bottom hole assembly, the swivel means circumscribing the drill string and interposed between the upper and lower segments of the air extraction means so as to permit simultaneous rotation of the lower segment of the air extraction means and the bottom hole assembly while maintaining the upper segment of the air extraction means stationary.

2. The system according to claim 1 including an inverted raiseboring cutterhead, the cutterhead including a plurality of cutters, a plurality of air nozzles exiting the cutterhead, the lower segment of the air supply means communicating with the nozzles, intake means disposed in the cutterhead communicating with the lower segment of the air extraction means, and means for affixing the cutterhead to a weight.

3. The system according to claim 1 wherein the weights are adapted to be stacked upon one another, the weights including a central bore and an outer bore, the central bore forming part of the air supply means, the outer bore forming part of the air extraction means, means for affixing a weight to the cutterhead, flange means for attaching a weight to the swivel, the flange means having apertures forming part of the air supply means and the air extraction means.

4. The system according to claim 1 wherein the interior of the drill string defines the upper segment of the air supply means.

5. The system according to claim 1 wherein at least one riser pipe defines the upper segment of the air extraction means.

6. The system according to claim 1 wherein the swivel means includes a stationary housing, a rotatable member disposed within the housing, the housing and the rotatable member having coincident adjacent annular passages therein to form a continuous annular passage passing through the swivel means, and the housing having an internal open diameter larger than the diameter of the drill string.

7. The system according to claim 6 wherein the housing includes an upper housing member affixed to a lower housing member, the upper housing member having the annular passage of the stationary housing, the rotatable member substantially enveloped by the upper housing member and the lower housing member, and bearing and sealing means disposed between the housing and the rotatable member.

8. The system according to claim 7 wherein a first frustoconical transition zone is affixed to the upper housing member, with the narrow dimension of the first transition zone directly connected to the annular passage of the upper housing member, a second frustoconical transition zone is affixed to the rotating member, with the narrow dimension of the second transition zone directly connected to the annular passage in the rotating member.

9. The system according to claim 8 wherein the upper segment of the air extraction means is connected to the wider dimension of the first transition zone and the lower segment of the air extraction means is connected to the wider dimension of the second transition zone.

10. The system according to claim 1 wherein the stabilizing means includes a rotatable bracket affixable to the drill string, a stationary frame supporting the bracket, means disposed between the bracket and the frame for permitting the bracket to rotate, a plurality of arrayed cushioning means affixed to the frame and adapted to contact the shaft, and means for attaching the frame to the upper segment of the air extraction means.

11. The system according to claim 10 wherein the cushioning means are tires.

12. The system according to claim 1 wherein a source of compressed air is connected to the air supply means.

13. The system according to claim 1 wherein a vacuum pump is connected to the air extraction means.

14. The system according to claim 13 wherein filtering means is disposed upstream flow-wise from the vacuum pump.

15. The system according to claim 2 wherein the nozzles are disposed adjacent to the cutters.

16. The system according to claim 2 wherein the cutters include randomly placed carbides.

* * * * *